US005416571A

United States Patent [19]

Yamada et al.

[11] Patent Number: 5,416,571

[45] Date of Patent: May 16, 1995

[54] DEVELOPING DEVICE FOR ELECTROPHOTOGRAPH-TYPE PRINTER

[75] Inventors: Koutaro Yamada; Yasuyuki Tsuji; Masayasu Anzai; Youji Hirose; Yukio Otome; Koji Doi; Youichi Takeuchi; Masami Yamaki; Katsuhiko Suzuki; Akira Takizawa, all of Ibaraki, Japan

[73] Assignee: Hitachi Koki Co., Ltd., Tokyo, Japan

[21] Appl. No.: 177,073

[22] Filed: Jan. 3, 1994

[30] Foreign Application Priority Data

Jan. 5, 1993 [JP] Japan ..... 5-000293

[51] Int. Cl.[6] ..... G03G 15/09

[52] U.S. Cl. ..... 355/251; 355/245; 355/253; 118/656; 118/657

[58] Field of Search ..... 355/245, 251–253, 355/246; 118/656–658

[56] References Cited

U.S. PATENT DOCUMENTS

| | | | |
|---|---|---|---|
| 3,572,289 | 3/1971 | Maksymiak | 118/651 X |
| 3,911,864 | 10/1975 | Hudson | 118/658 |
| 3,921,577 | 11/1975 | Howard et al. | 118/658 |
| 4,246,867 | 1/1981 | Hudson | 118/658 X |

FOREIGN PATENT DOCUMENTS

| | | |
|---|---|---|
| 53-41534 | 11/1978 | Japan . |
| 62-45552 | 9/1987 | Japan . |
| 1503811 | 12/1989 | Japan . |

*Primary Examiner*—Matthew S. Smith
*Attorney, Agent, or Firm*—Sughrue, Mion, Zinn, Macpeak & Seas

[57] ABSTRACT

In a multi-stage roll magnetic brush type of developing device, at least two opposite direction rotation rolls which rotate in an opposite rotation direction to that of a photosensitive body are arranged adjacently and oppositely to a photosensitive body, and at least one same direction rotation developing roll which rotates in the same rotation direction as that of the photosensitive body is arranged adjacently, oppositely to the photosensitive body and upstream of the opposite direction rotation developing rolls in the rotation direction of the photosensitive body. Thus, the path of carrying the developer by the same direction rotation developing roll and the opposite direction rotation developing rolls can be optimized. In the wide area printing at high speed, an image with stabilized printing quality can be obtained without an increase in the production cost.

8 Claims, 2 Drawing Sheets

DEVELOPING DEVICE FOR ELECTROPHOTOGRAPH-TYPE PRINTER

BACKGROUND OF THE INVENTION

1. Field of the Invention

The present invention relates to a developing device for an electrophotographic printer, and more particularly to a developing device of a multi-stage roll magnetic brush type in a center feed system.

2. Description of the Related Art

A multi-stage roll developing system can provide a higher developing capability than a single roll developing system. Because of such an advantage, the multi-stage roll developing system can deal with a wide area image printing and improve image quality. In addition, the multi-stage developing system can reduce the toner content of a developer and lower the rotating speed of a developing roll. Thus, the spraying of toner and the load to the developer will be decreased so that the long life of the developer can be assured.

The multi-stage roll developing system can be classified roughly into two systems of a uni-directional feed system, as described in Japanese Patent Publication No. 53-41534 (1978) in which plural (two to four) developing rolls are rotated in the same direction and a center feed system in which two developing rolls are rotated in opposite directions. The identical direction (or sense) rotation development in the unidirectional feed system in which the rotation direction of a developing roll is identical to that of a photosensitive body can provide a high developing capability, but has disadvantages that it gives background fog, missing of the front end of an image and noticeable traces of a magnetic brush.

The opposite direction rotation development in which the rotation direction of the developing roll is opposite to that of the photosensitive roll can provide stabilized image quality because it gives missing of the rear end of the image, however less background fog and less noticeable traces of the magnetic brush. However, the opposite direction rotation development, in which the relative speed of the photosensitive body and the developing roll is low and the effective toner amount in contact with the above photosensitive body is little, provides reduced developing capability. On the other hand, the center feed system, which has both developing rolls for the identical rotation development and opposite direction rotation development, respectively, can obviate defects of above two developing systems.

Referring to FIG. 2, an explanation will be given of an example of the developing device in the center feed system, as disclosed in Japanese Patent Examined Publication No. Sho 62-45552 (1987).

Two developing rolls 5 and 14 are arranged oppositely and adjacently to a photoconductive photosensitive body 1. Each of the developing rolls 5 and 14 is composed of an inner magnet and an outer sleeve. The developing roll 5 serves for the opposite direction rotation development whereas the developing roll 14 serves for the identical direction rotation development. A developing agent or developer 3 in a developer container 2 is carried below the developing roll 5 by a carrying member 4. The developer 3 is deposited on the surface of a sleeve 11 of the roll 5 owing to the magnetic aspiration or induction force of a fixed magnet 8 of the roll 5. The deposited developer 3 moves along the rotation direction of the sleeve 11 of the roll 5. The amount of the developer 3 to be deposited for the opposite direction rotation development is secured by a distributing member 21. The developer 3 is carried to a development area and subjected to the opposite rotation development. Thereafter, the developer 3 is returned to the developer container 2. The rest of the developer 3 removed by the distributing member 21 is deposited on the surface of a sleeve 16 of the developing roll 14 owing to the induction force of a fixed magnet 15 of the roll 14. The developer 3 deposited on the roll 14 moves along the rotation direction of the sleeve 16 of the roll 14. The amount of the developer to be deposited for the identical direction rotation development is also secured by the distributing member 21. The developer 3 is subjected to the same direction rotation development. Thereafter, the developer 3 is returned to the developer container 2. Incidentally, reference numeral 23 denotes a toner hopper and 24 denotes a toner feed roll.

The above prior art center feed system of the developing device, in which a single opposite direction rotation roll and a single opposite direction rotation roll are provided, can provide sufficient developing capability in a low or middle speed printing, but cannot deal with high speed printing used for a wide area image. Referring to FIG. 3, an explanation will be given of an example of the developing device in the center feed system using three or more developing rolls, as disclosed in Japanese Patent Examined Publication No. Hei 1-45552 (1989).

Three developing rolls 5, 6 and 14 are arranged oppositely and adjacently to a photoconductive photosensitive body 1. Each of the developing rolls 5, 6 and 14 is composed of an inner magnet and an outer sleeve. The developing rolls 5 and 6, which are located upstream of the roll 14, rotate in an opposite direction to that of the photoconductive body 1 and serves for the first and second opposite direction rotation development whereas the developing roll 14, which is located downstream of the roll 6, rotates in the same direction as that of the photoconductive body 1 and serves for the identical direction rotation development. A developing agent or developer 3 in a developer container 2 is carried below the developing roll 5 by a carrying member 4. The developer 3 is deposited on the surface of a sleeve 11 of the roll 5 owing to the magnetic aspiration or induction force of a fixed magnet 8 of the roll 5. The deposited developer 3 moves along the rotation direction of the sleeve 11 of the roll 5. The amount of the developer to be deposited for the first opposite direction rotation development is secured by a distributing member 21. The developer 3 is carried to a development area where the photosensitive body 1 and the roll 4 are adjacent to each other and subjected to the opposite rotation development in the development area moving in the same direction as that of the photosensitive body 1. Further, the rest of the developer 3 is deposited on the surface of a sleeve 12 of the roll 6 owing to the magnetic aspiration or induction force of a fixed magnet 9 of the roll 6. The deposited developer 3 moves along the rotation direction of the sleeve 12 of the roll 6 and is subjected to the second opposite direction rotation development.

The remaining portion of the developer 3 is carried to the most downstream roll 14. The developer 3 is deposited on the surface of a sleeve 16 of the developing roll 14 owing to the induction force of a fixed magnet 15 of the roll 14. The developer 3 deposited on the roll 14 moves along the rotation direction of the sleeve 16 of the roll 14 in the same direction as that of the photosensitive body 1. The amount of the developer to be deposited for the same direction rotation development is secured by a distributing/control member 25. The developer 3 is subjected to the identical direction rotation development in the same manner as the above opposite rotation direction development.

Most of the developer 3 controlled and scraped off by the control member 25 is returned to the developer container 2. The developer 3, after subjected to the same direction rotation development, joins the developer supplied from the side of the roll 6, and repeats to rotate on the roll 14 until it is scraped off by the controller 25 so as to be returned to the developer container 2.

The prior art system described above can exhibit high developing capability in the high speed printing. However, this system has also the following defect. Since the roll 14 for the identical rotation direction development is arranged at the outlet of the development, the printing quality may be affected by missing of the front edge of an image and traces of a brush which are features of the identical rotation direction developing system. As a result, the printing quality is not stable.

As described previously, in the multi-roll system, the identical direction rotation development in the unidirectional feed system can provide a high developing capability, but has disadvantages that it gives background fog due to excessive application of toner and missing of the front edge of an image. On the other hand, the opposite direction rotation development can provide stabilized image quality with less disorder in the front edge of an image and less background fog than in the identical rotation direction development. However, the opposite direction rotation development, in which the effective toner amount in contact with the above photosensitive body is little, provides reduced developing capability.

As described above, the center feed system having both development manners can obviate the above defects. However, the two roll system in which a single roll is provided for each of the opposite rotation direction development and the identical rotation direction development, as disclosed in Japanese Patent Examined Publication No. Sho 62-45552, cannot sufficiently deal with the wide area printing at a high speed.

For this reason, the developing device in the center feed system using three or more developing rolls, as disclosed in Japanese Patent Examined Publication No. Hei 1-503811, has been required. Such a developing device, however, also has a disadvantage in that it is restricted by the arrangement of the opposite rotation developing roll and identical direction rotation developing roll so that the carrying path of a developer becomes complicated.

SUMMARY OF THE INVENTION

An object of the present invention is to provide a developing device for an electrophotograph-type printer which, in a center feed system using three or more developing rolls, can improve and optimize the path on which a developer is carried by the identical direction rotation developing roll and opposite direction rotation roll, and can also always provide stabilized printing quality in a high speed wide-area printing without increasing production cost so much.

In order to achieve the above object, in accordance with an aspect of the present invention, there is provided a multi-stage roll magnetic brush type of developing device in a center feed system for an electrophotographic printer including developing rolls having magnetic induction force which rotate in different directions from one another, the developing rolls being arranged oppositely and adjacently to a photosensitive body, a developer container for retaining a developer, a carrying member for supplying the developer from the developing container to the developing rolls and a toner hopper for retaining toner, wherein said developing rolls comprise at least two opposite direction rotation developing rolls which are arranged adjacently and oppositely to the photosensitive body and rotate in an opposite rotation direction to that of the photosensitive body, and at least one identical direction rotation developing roll which is arranged adjacently, oppositely to the photosensitive body and upstream of the opposite direction rotation developing rolls in the rotation direction of the photosensitive body, and rotates in the same rotation direction as that of the photosensitive body.

In the multi-stage developing device in a center feed system according to the present invention, the identical direction rotation roll first develops the latent image on the surface of the photosensitive body. The image thus formed is missing in the front edge of its wide area image and has traces of a magnetic brush. However, the subsequent opposite rotation direction developing roll removes the missing of the front edge and the traces of the brush on the image and makes up shortage of development. The above identical direction rotation developing roll can wash the photosensitive body to remove impurities such as the toner applied to the surface of the photosensitive body and paper dust.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Figure 1:
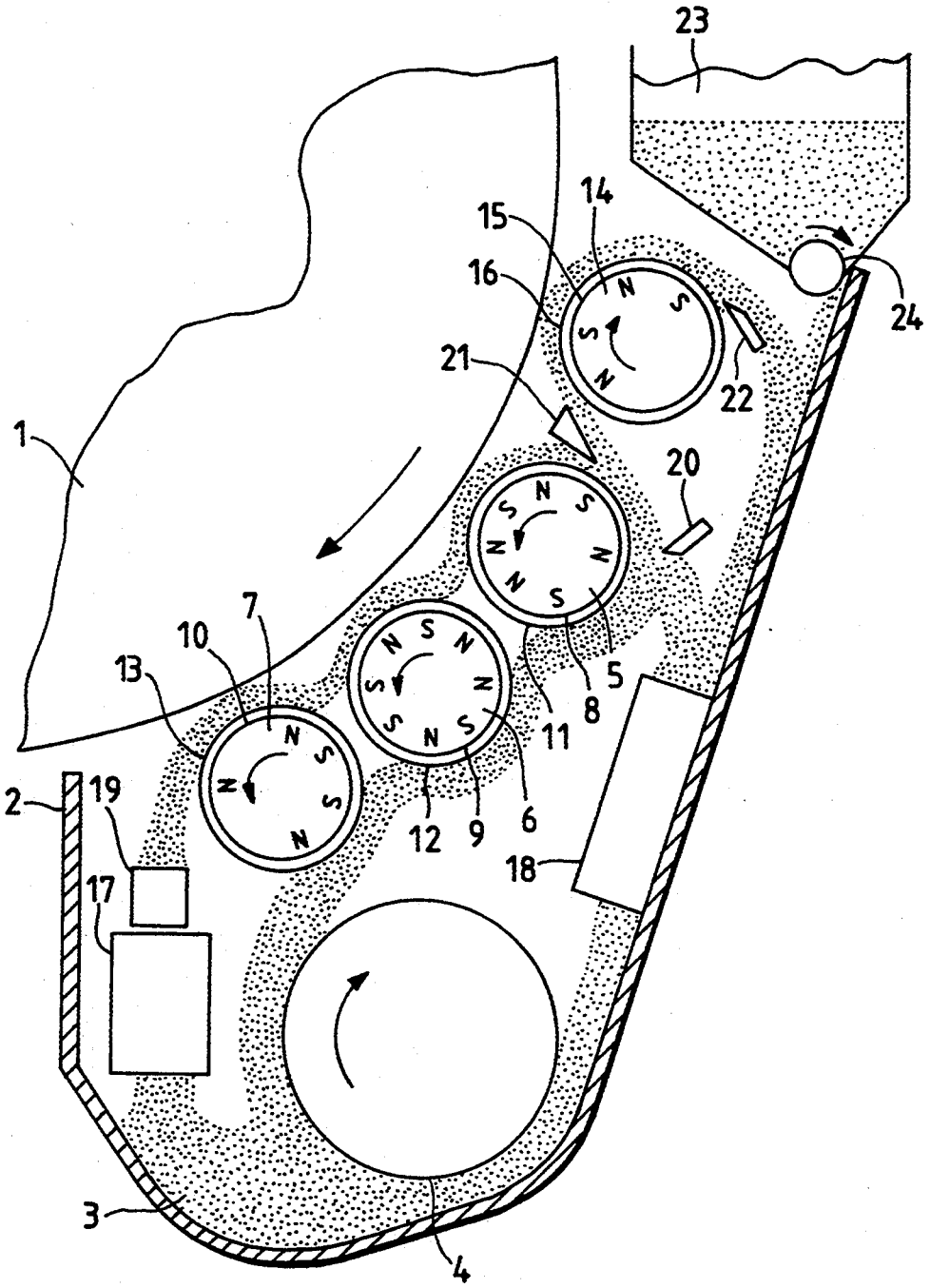
FIG. 1 is a schematic view illustrating a developing device of an electrophotographic printer according to one embodiment of the present invention.
Figure 2:
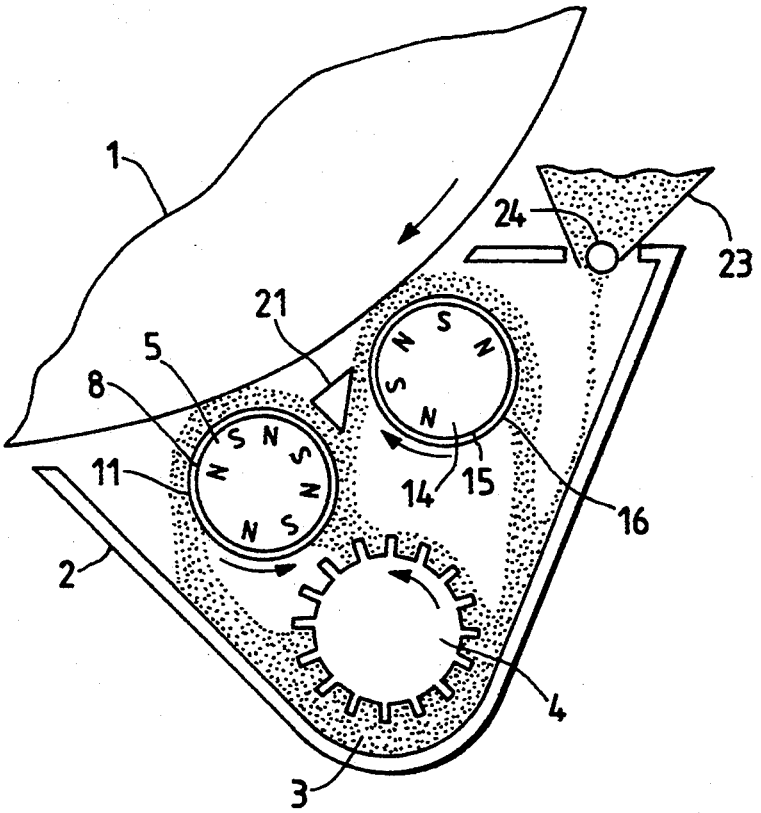
FIG. 2 PRIOR ART
FIG. 2 is a schematic view illustrating a developing device of an electrophotographic printer according to a prior art.
Figure 3:
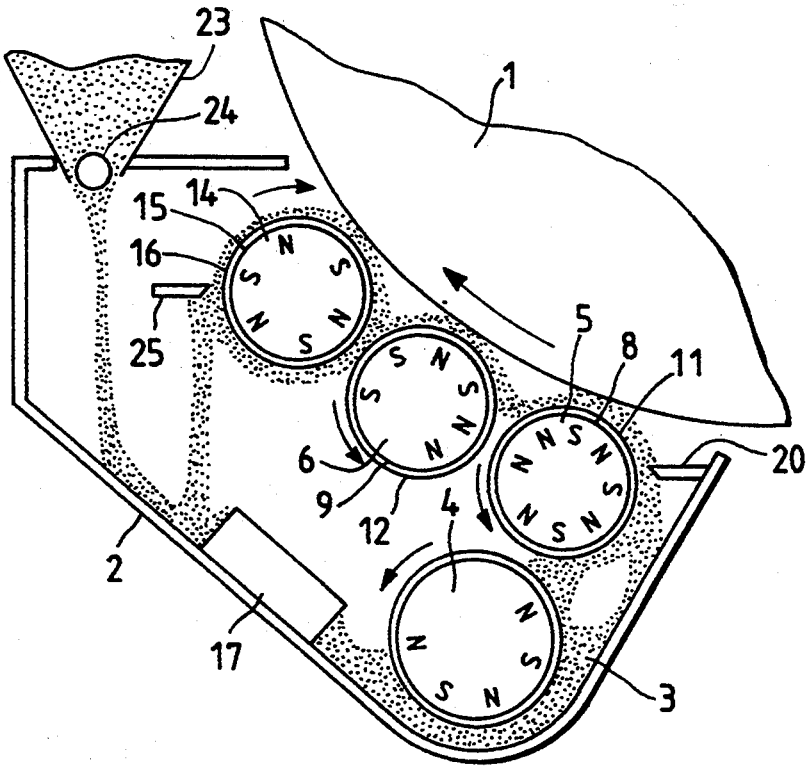
FIG. 3 PRIOR ART
FIG. 3 is a schematic view illustrating a developing device of an electrophotographic printer according to another prior art.

Now referring to FIG. 1, an explanation will be given of an embodiment of the present invention.

The first, second and third three opposite direction rotation rolls 5, 6 and 7 which rotate in an opposite direction rotation to that of a photoconductive photosensitive body 1 are arranged adjacently and oppositely to the photosensitive body 1 on the downstream side, and an identical direction rotation developing roll 14 which rotates in the same rotation direction as that of the photosensitive body 1 is arranged adjacently and oppositely to the photosensitive body 1 on the upstream side. These developing rolls 5, 6, 7 and 14 are composed of fixed magnets 8, 9, 10 and 15 and sleeves 11, 12, 13 and 16 which surround the fixed magnets and rotate around them, respectively. The respective magnets 8, 9 and 10 of the opposite direction rotation developing rolls 5, 6 and 7 have a pair or two pairs of adjacent magnetic poles with the same polarity (S, S or N, N)

and other adjacent magnetic poles with different polarities (S, N). The same polarity portions are fixed at the closest position between the opposite direction rotation developing rolls 5 and 6 and between the roles 6 and 7. On the other hand, the magnet 15 of the identical direction rotation developing roll 14 has all adjacent magnetic poles with different polarities. Incidentally, the rotating speed of the identical direction rotation developing roll 14 is so set that it is equal or slightly higher than that of the opposite direction rotation developing rolls 5, 6 and 7.

As a means for supplying developer 3 from the developer container 2 to these developing rolls, a rotatable carrying member 4 is provided between the developer 2 and the most downstream third opposite direction rotation developing roll 7. This carrying member 4 has the same magnetic induction force as the developing rolls have. Because of the induction force of the carrying member 4, the developer 3 is supplied from the developer container 2 to the surface of the third opposite direction rotation developing roll 7. The developer 3 thus supplied, because of the induction force of the developing roll 7, is deposited on the surface thereof. Because of the above magnetic pole arrangement and the opposite direction rotation of the sleeve 13, the rest of the developer 3 moves upstream on the lower side of the third opposite direction rotation developing roll 7 and is supplied to the second opposite direction rotation developing roll 6 on the upstream side. Likewise, a further portion of the developer 3 is supplied from the second opposite direction rotation roll 6 to the first opposite direction rotation roll 5. Further, the rest of the developer 3 is supplied between the first opposite direction rotation developing roll 5 and the identical direction rotation developing roll 14. Then, the amount of the developer 3 is controlled by a control member 20 arranged on the lower side of the first opposite direction rotation developing roll 5 with a gap (e.g. 2 mm) from the roll 5 so that it is equal to the sum amount of the developer to be deposited for development on the opposite direction rotation developing rolls 5, 6 and 7 and the identical direction rotation developing roll 14.

The rest of the developer 3 removed from control by the control member 20 drops into a cross mixer 18 arranged under the control member 20. It is stirred there and returned to the developer container 2.

The developer 3, the deposition amount of which has been controlled by the control member 20, is controlled again in its deposition amount by a distributing member 21 arranged with a gap (e.g. 1 mm) between the first opposite direction rotation developing roll 5 and the identical rotation direction developing roll 14. Thereafter, it is carried to the developing areas where the photosensitive body 1 and the opposite direction rotation rolls 5, 6 and 7 are adjacent to each other and contributes to the opposite rotation direction development.

On the other hand, the rest of the developer 3 removed from control by the distributing member 21 is deposited on the surface of the identical direction rotation roll 14 because of its induction force. The amount of the developer to be deposited is controlled by the distributing member 21 arranged with a gap (e.g. 1 mm) from the roll 14. The developer is carried to the developing area where the photosensitive body 1 and the identical direction rotation developing roll 14 are adjacent to each other and contributes to the identical direction rotation development. The developer after having contributed to the identical direction rotation development is scraped off by a scraper 22 and drops into the cross-mixer 18. It is stirred there and returned to the developer container 2. The developer 3 after having contributed to the opposite direction rotation development is supplied to a toner density detector 19 under the most downstream third opposite direction rotation roll 7. Further, it drops into the cross-mixer 17 under the toner density detector 19, stirred there and returned to the developer container 2.

The toner density detector 19 produces a signal corresponding to the content of toner in the developer. When the produced signal is below a prescribed level (e.g. 2 V), the toner feed control 24 of a toner hopper 23 arranged on the developer outlet side of the roll 14 rotates so as to drop toner from the toner hopper 23. Thus, the toner hopper 23 supplies the toner until the produced output signal reaches the prescribed level. The dropped toner is supplied to the cross mixer 17, mixed with the developer 3 having contributed to the development and stirred. The resultant developer is stored in the developer container 2.

The provision of the toner hopper 23 on the developer outlet side of the identical direction rotation developing roll 14 can lengthen the time while the supplied toner mixes with the developer 3. This increases the charge amount of the toner and thus can enhance the printing quality. The toner density detector 19 arranged on the developer outlet side of the most downstream opposite direction rotation developing roll 7 can detect a change in the toner density by printing, thereby increasing the response of toner supply.

In accordance with the present invention, the arrangement of developing rolls can be made in an optimized order of the identical direction rotation developing roll and the opposite direction rotation developing roll. Therefore, even in the wide area image printing at high speed, the image with stabilized high printing quality can be always obtained. Further, since the opposite direction rotation developing rolls serve as a carrying member, no complicated carrying path is required so that the developing device can be realized without an increase in the production cost.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A multi-stage roll magnetic brush type developing device in a center feed system for an electrophotographic printer, said device comprising:

a photosensitive body;

developing roll members having magnetic induction force which rotate in different directions from each other, said developing roll members being arranged oppositely and adjacently to said photosensitive body;

a developer container for retaining a developer;

a carrying member for supplying the developer from said developing container to said developing roll members; and a toner hopper for retaining toner, wherein said developing roll members comprise:

at least two opposite direction rotation developing rolls which are arranged adjacently and oppositely to said photosensitive body, are disposed in side-by-side but non-contacting relationship with respect to each other, and rotate in an opposite rotation direction to that of said photosensitive body, and at least one same direction rotation developing roll which is arranged adjacently, oppositely to said photosensitive body and upstream of the opposite direction rotation developing rolls in the rotation direction of said photosensitive body, and rotates in the same rotation direction as that of said photosensitive body.

2. A multi-stage roll magnetic brush type developing device according to claim 1, further comprising:

a first controller for controlling the amount of developer to be deposited on said developing roll members so that it is equal to the sum amount of developer on all of said developing roll members, said first controller being arranged under the most upstream opposite direction rotation developing roll with a prescribed gap therefrom;

a second controller for controlling the amount of developer to be deposited on the opposite direction rotation developing rolls, said second controller being arranged between the most upstream opposite direction rotation developing roll and the same direction rotation developing roll with a prescribed gap; and a third controller for controlling the amount of developer to be deposited on the same direction rotation developing roll, said third controller being arranged with a prescribed gap therefrom.

3. A multi-stage roll magnetic brush type of developing device according to claim 1, wherein said toner hopper is arranged on the developer outlet side of the same direction rotation developing roll.

4. A multi-stage roll magnetic brush type of developing device according to claim 1, further comprising:

a toner density detector for detecting the content of toner in said developer, said detector being arranged on the developer outlet side of the most down-stream opposite direction rotation developing roll.

5. A multi-stage roll magnetic brush type of developing device according to claim 1, wherein three opposite direction rotation developing rolls and one same direction rotation developing roll are provided.

6. A multi-stage roll magnetic brush type developing device in a center feed system for an electrophotographic printer, said device comprising:

a photosensitive body;

developing roll members having magnetic induction force which rotate in different directions from each other, said developing roll members being arranged oppositely and adjacently to said photosensitive body;

a developer container for retaining a developer;

a carrying member for supplying the developer from said developing container to said developing roll members; and a toner hopper for retaining toner, wherein said developing roll members comprise:

at least two opposite direction rotation developing rolls which are arranged adjacently and oppositely to said photosensitive body and rotate in an opposite rotation direction to that of said photosensitive body, and at least one same direction rotation developing roll which is arranged adjacently, oppositely to said photosensitive body and upstream of the opposite direction rotation developing rolls in the rotation direction of said photosensitive body, and rotates in the same rotation direction as that of said photosensitive body;

wherein said device further comprises:

a first controller for controlling the amount of developer to be deposited on said developing roll members so that it is equal to the sum amount of developer on all of said developing roll members, said first controller being arranged under the most upstream opposite direction rotation developing roll with a prescribed gap therefrom;

a second controller for controlling the amount of developer to be deposited on the opposite direction rotation developing rolls, said second controller being arranged between the most upstream opposite direction rotation developing roll and the same direction rotation developing roll with a prescribed gap; and a third controller for controlling the amount of developer to be deposited on the same direction rotation developing roll, said third controller being arranged with a prescribed gap therefrom.

7. A multi-stage roll magnetic brush type developing device in a center feed system for an electrophotographic printer, said device comprising:

a photosensitive body;

developing roll members having magnetic induction force which rotate in different directions from each other, said developing roll members being arranged oppositely and adjacently to said photosensitive body;

a developer container for retaining a developer;

a carrying member for supplying the developer from said developing container to said developing roll members; and a toner hopper for retaining toner, wherein said developing roll members comprise:

at least two opposite direction rotation developing rolls which are arranged adjacently and oppositely to said photosensitive body and rotate in an opposite rotation direction to that of said photosensitive body, and at least one same direction rotation developing roll which is arranged adjacently, oppositely to said photosensitive body and upstream of the opposite direction rotation developing rolls in the rotation direction of said photosensitive body, and rotates in the same rotation direction as that of said photosensitive body;

wherein said device further comprises:

a toner density detector for detecting the content of toner in said developer, said detector being arranged on the developer outlet side of the most downstream opposite direction rotation developing roll.

8. A multi-stage roll magnetic brush type developing device in a center feed system for an electrophotographic printer, said device comprising:

a photosensitive body;

developing roll members having magnetic induction force which rotate in different directions from each other, said developing roll members being arranged oppositely and adjacently to said photosensitive body;

a developer container for retaining a developer;

a carrying member for supplying the developer from said developing container to said developing roll members; and a toner hopper for retaining toner, wherein said developing roll members comprise:

at least two opposite direction rotation developing rolls which are arranged adjacently and oppositely to said photosensitive body and rotate in an opposite rotation direction to that of said photosensitive body, and at least one same direction rotation developing roll which is arranged adjacently, oppositely to said photosensitive body and upstream of the opposite direction rotation developing rolls in the rotation direction of said photosensitive body, and rotates in the same rotation direction as that of said photosensitive body;

further wherein three opposite direction rotation developing rolls and one same direction rotation developing roll are provided.

* * * * *